US005332208A

United States Patent [19]

Tsuji et al.

[11] Patent Number: 5,332,208

[45] Date of Patent: Jul. 26, 1994

[54] PAPER-SUPPLYING DEVICE

[75] Inventors: Hiroyuki Tsuji; Shigeo Kurand; Yoshihiro Tohnai; Yukio Hashimoto; Hidekazu Sakagami, all of Osaka, Japan

[73] Assignee: Mita Industrial Co., Ltd., Osaka, Japan

[21] Appl. No.: 137,977

[22] Filed: Oct. 19, 1993

[30] Foreign Application Priority Data

Nov. 7, 1992 [JP] Japan ..... 4-322497
Nov. 7, 1992 [JP] Japan ..... 4-322498

[51] Int. Cl.[5] ..... B65H 1/00
[52] U.S. Cl. ..... 271/171; 271/240
[58] Field of Search ..... 271/171, 240

[56] References Cited

FOREIGN PATENT DOCUMENTS 61425 4/1985 Japan ..... 271/171
185730 8/1988 Japan ..... 271/171

*Primary Examiner*—Richard A. Schacher
*Attorney, Agent, or Firm*—Wenderoth, Lind & Ponack

[57] ABSTRACT

A paper supplying deck is insertable into and withdrawable from a paper supplying portion of a body resulting in electrical connection between the side of the paper supplying deck and the side of the body through a drawer-type connector when the paper supplying deck is inserted and interruption of such electrical connection when the drawer is withdrawn. The paper supplying deck has a paper carrying portion with a paper width setting mechanism and a variable resistor the resistance value of which is changed in dependence on the paper width setting mechanism, thereby changing an output paper width detecting voltage. On the wide of the paper supplying deck, a resistance which prevents the paper width detecting voltage from amounting to a power source voltage even though the resistance value of the variable resistor reaches a maximum value, is connected in series with the variable resistor. On the side of the body, a pull up resistance is connected with the connector to discriminate between voltages in the connector when the paper supplying deck is mounted and when the paper supplying deck is not mounted.

4 Claims, 8 Drawing Sheets

| | STANDARD DATA |
|---|---|
| B 6 | V 11N1 |
| A 5 | V 11N2 |
| B 5 R | V 11N3 |
| ⋮ | ⋮ |

| | | DETECTION IN THE DIRECTION OF WIDTH | | | | | |
|---|---|---|---|---|---|---|---|
| | | NO. 1 | NO. 2 | NO. 3 | NO. 4 | NO. 5 | NO. 6 |
| DETECTION IN THE LONGITUDINAL DIRECTION | (NO) | B6 | A5 | B5R | A4R | B5 | A4 |
| | (YES) | — | — | — | — | B4 | A3 |

PAPER-SUPPLYING DEVICE

BACKGROUND OF THE INVENTION

1. Field the Invention

The present invention relates to a paper supplying device provided in an image forming apparatus, a printer and the like.

2. Description of the Prior Art

In a conventional paper supplying device provided in, for example, an image forming apparatus, a variable resistor 52 changing a resistance value in an interlocked relation with a paper width setting mechanism on a side of a paper supplying deck 50 is connected between a constant voltage power source 53 of, for example, 5V and a ground 54 and is connected with one pin 56*c* of a member 55*a* on such side of the deck where a sliding tap 52*a* of variable resistor 52 constitutes a drawer-type connector 55, as shown in FIG. 10. On the other hand, one pin 57*c*, corresponding to a pin 56*c*, of a body side member 55*b* of drawer-type connector 55 is connected with an input port of a controller (not shown) on a side of a body 51. With this construction, the resistance value of the variable resistor 52, in short a resistance from sliding tap 52*a* to ground 54, is converted into a voltage to be input to the controller through the connector 55 as a datum of a paper width set by means of the paper setting mechanism, whereby a width of a paper carried on a paper carrying portion of the paper supplying deck 50 is confirmed on a side of body 51 under the condition that the paper supplying deck 50 is mounted on a paper supplying portion of the body 51. That is, the deck-side member 55*a* of the drawer-type connector 55 is connected with body-side member 55*b*.

In addition, one pin 57*a* of the body-side member 55*b* constituting the drawer-type connector 55 is connected with a constant voltage power source 59 of, for example, 5V through a pull-up resistance 58 and a separate input port of the controller. Moreover, the other pin 57*b* of the body-side member 55*b* is connected with a ground 60. On the other hand, two pins 56*a*, 56*b* of the deck-side member 55*a* corresponding to pins 57*a*, 57*b* are connected with each other through a short circuit line 61. With this construction, a ground voltage, in short 0V, is input to the controller through the pin 57*a* under the condition that the paper supplying deck 50 is mounted on the paper supplying portion of the body 51, while a power source voltage, in short 5V, is input to the controller under the condition that the paper supplying deck 50 is not mounted on the body 51. It is confirmed on the side of the body 51 from this difference in input voltage whether or not the paper supplying deck 50 is mounted, and the paper supplying operation is started after confirming that the paper supplying deck 50 is mounted.

However, with the above described construction, problems have occurred in that not only are three pins required, i.e. two pins for detecting whether or not the paper supplying deck 50 is mounted on the body 51 and one pin for detecting the paper width, as pins of the drawer-type connector 55, but also the input port for inputting a mounting detecting signal and the input port for inputting a paper width detecting signal are required also for the controller on the side of the body 51. Thus, the cost is increased.

Besides, as for the conventional image forming apparatus, it has been known that a paper supplying deck mounted so as to be inserted into and withdrawn from a paper supplying portion of a body is provided with a sensor for detecting a size of a paper carried thereon, and a paper supplying operation is conducted in correspondence to the size of paper detected by means of such sensor.

In such detection of the size of the paper, it is necessary to detect sizes in two directions, that is the direction of width and the longitudinal direction. For example, as for typical papers of centimeter measure, it is required that the size in the direction of width is discriminated among six paper types, that is B6, A5, B5R, B5 and A4. Also, as for typical papers of inch measure, it is required that the size in the direction of width is discriminated among three paper types, that is 5.5×8.5, 8.5×11R and 8.5×11. On the other hand, the size in the longitudinal direction of such typical papers is absolutely determined in many cases depending upon the size in the direction of width.

That is to say, for example in case of the typical papers of centimeter measure, as shown in FIG. 11, the discrimination of B4 paper from B5 paper and of A4 paper from A3 paper can be conducted by confirming "Yes" or "No" on a rear portion of the paper by means of the sensor arranged at an appointed position in the longitudinal direction. This is equally true also in case of the typical papers of inch measure.

In the detection of the size in the direction of width of the paper in this case, a lead switch, a photo-interrupter, a slide-type variable resistor or the like can be used as the sensor, while in the detection of the size in the longitudinal direction, a lead switch, a photo-interrupter or the like can be used as the sensor.

However, in case of the conventional example, two detecting systems in the direction of width and the longitudinal direction have been required for discriminating the size of paper. For example, in an example where sensors corresponding to the respective sizes in the direction of width are provided, in the controller receiving size detecting signals from such sensors, in case of the typical papers of centimeter measure, the input port for receiving six types of size detecting signals in the direction of width and the input port for receiving one size detecting signal in the longitudinal direction have been required. That is to say, seven total input ports have been required in such case.

On the contrary, in the case where an output voltage $V_o$ changing depending upon a change of variable resistor 70, which is interlocked with a paper width setting mechanism, in resistance value is put in an analog input port of a controller 71 as the size detecting signal in the direction of width, as shown in FIG. 12, it is enough to use two input ports, that is the analog input port of the detecting signal in the direction of width and an input port of the detecting signal in the longitudinal direction detected by means of a switch 72.

However, also in this case, at least two systems of input ports have been required for discriminating the sizes of the respective typical papers by means of controller 71, and thus a problem has occurred in that a program for discriminating the sizes of papers in the controller 71 is complicated.

SUMMARY OF THE INVENTION

It is a first object of the present invention to provide a paper supplying device capable of reducing a number of pins of a drawer-type connector electrically connecting a side of a paper supplying deck with a side of a body and of reducing a number of input ports of a controller on the side of the body and to which are input a mounting detecting signal and paper width detecting signals. It is a second object of the present invention to provide a paper supplying device requiring only one input port of a controller for receiving detection signals of sizes of papers.

In order to achieve such first object, a paper supplying deck has a paper carrying portion with a paper width setting mechanism and a variable resistor changing a resistance value in an interlocked relation with the paper width setting mechanism to output a paper width detecting voltage in dependence upon such resistance value. The deck is adapted to be inserted into and withdrawn from a paper supplying portion of a body. Electrically connection between a side of the paper supplying deck with a side of the body is achieved through a drawer-type connector by insertion of the deck. A limit voltage avoiding resistance, which prevents the paper width detecting voltage from amounting to a power source voltage even though the resistance value of the variable resistor reaches a maximum value, is connected in series with the variable resistor on the side of the paper supplying deck. A pull up resistance is connected with the connector on the side of the body to discriminate a voltage in the connector on the side of the body between a voltage with the paper supplying deck is mounted and a voltage when the paper supplying deck is not mounted.

According to this construction, the paper width detecting voltage input to a controller on the side of the body from the variable resistor on the side of the paper supplying deck through the drawer-type connector becomes lower than the power source voltage when the paper supplying deck is mounted on the paper supplying portion of the body. However, a voltage input to the controller on the side of the body becomes equal to the power source voltage when the paper supplying deck is not mounted on the paper supplying portion of the body. This discrimination of a difference in these voltages levels in the controller detects whether or not the paper supplying deck is mounted on the paper supplying portion of the body. Accordingly, it is not required to provide the drawer-type connector with separate pins for detecting that the paper supplying deck is mounted on the paper supplying portion of the body, or to provide the controller on the side of the body with a separate input port for inputting a mounting detecting signal. Thus, the number of pins of the drawer-type connector and the number of input ports of the controller can be reduced, thereby reducing the cost.

In addition, a limit voltage avoiding resistance, which prevents the paper width detecting voltage from amounting to a ground voltage even though the resistance value of the variable resistor reaches a minimum value, may be connected in series with the variable resistor on the side of the paper supplying deck. A pull down resistance may be connected with the connector on the side of the body. According to this construction, the paper width detecting voltage input to the controller on the side of the body from the variable resistor on the side of the paper supplying deck through the drawer-type connector exceeds the ground voltage when the paper supplying deck is mounted on the paper supplying portion of the body. However, a voltage input to the controller on the side of the body becomes equal to the ground voltage when the paper supplying deck is not mounted on the paper supplying portion of the body. Also in this construction, discrimination is made between a difference of voltage levels whether or not the paper supplying deck is mounted on the paper supplying portion of the body in the paper supplying device.

And, in order to achieve the above second subject of the invention, a paper supplying device is provided with a paper supplying box or deck carrying papers and having a paper width setting mechanism and a variable resistor changing a resistance value thereof in an interlocked relation with the paper width setting mechanism to output a paper width detecting voltage corresponding to the resistance value. A switch detects a size in the longitudinal direction by detecting a rear portion of papers carried on the paper supplying box. A resistor of a resistance larger than the total resistance of the variable resistor is connected in series with the variable resistor, and the switch is connected in parallel with the larger resistance resistor. The paper width detecting voltage output from the variable resistor may be input to the controller also as a signal indicative of paper size in the longitudinal direction.

According to this construction, a difference is produced between the paper width detecting voltage levels output from the variable resistor when the rear portion of paper carried on a paper supplying deck does not act on the switch and when the rear portion of the paper acts upon the switch. The controller receives such different signals through one input port, and the size in the longitudinal direction can be discriminated on the basis of such difference. Accordingly, the number of input ports in the controller can be reduced. Thereby, a program in the controller for discriminating the sizes of the papers can be simplified.

DESCRIPTION OF PREFERRED EMBODIMENTS

Figure 2:
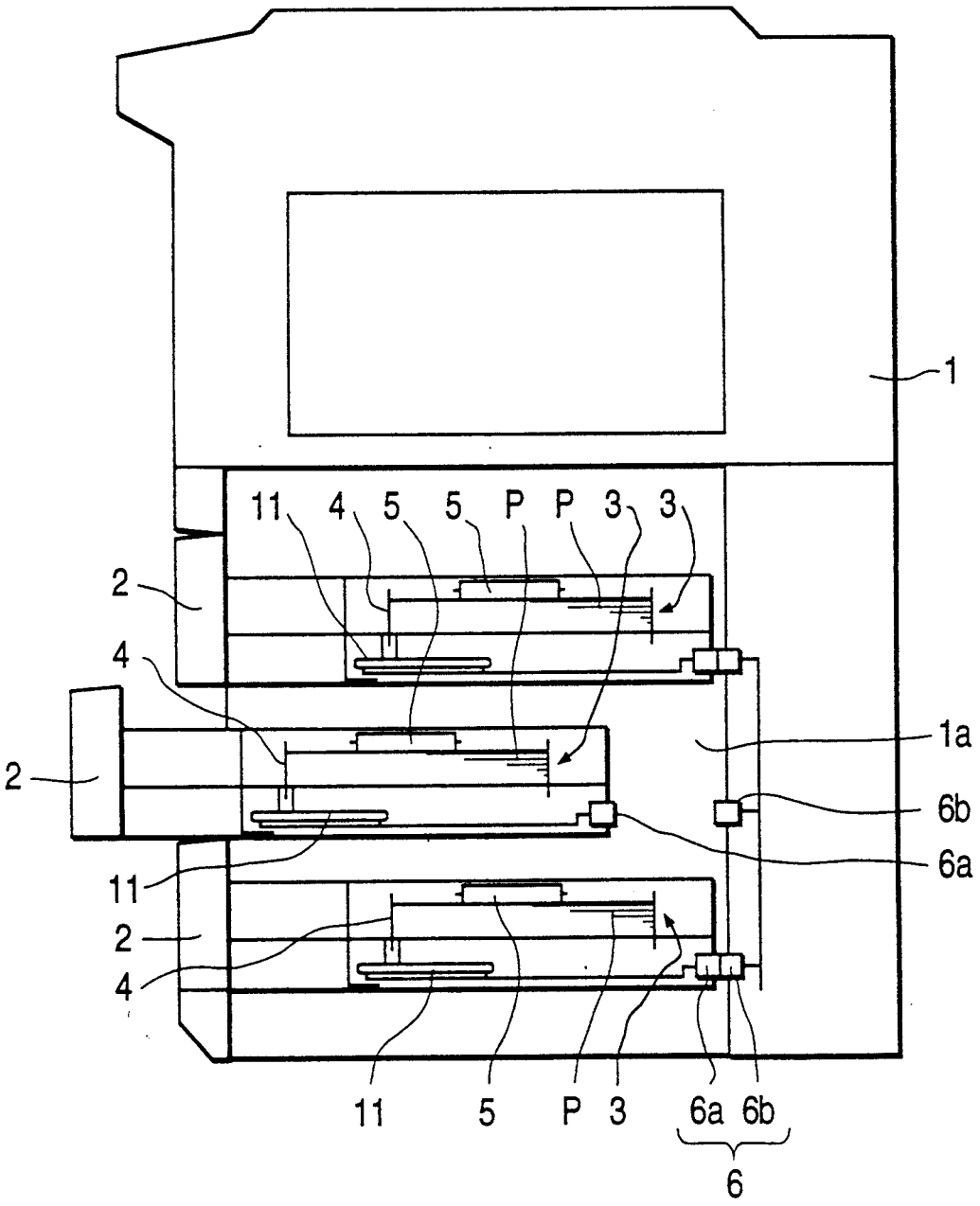
FIG. 2 is a side sectional view roughly showing an image forming apparatus to which such first aspect of the invention is applied.

A first aspect of the invention will be described below. FIG. 2 is a side sectional view roughly showing a front loading-type image forming apparatus to which the first aspect of the invention is applied. Referring to FIG. 2, reference numeral 1 designates a body of the image forming apparatus of which paper supplying portion la is provided with a plurality of paper supplying decks 2 to be inserted therein and removed therefrom in a multi-step manner from a front side of body 1. Each paper supplying deck 2 is provided with a paper carrying portion 3 having a paper width setting mechanism 4 and a paper supplying roller 5 for supplying paper supplying portion 1*a* of the body 1 with a paper P carried on paper carrying portion 3. The body 1 is electrically connected with the paper supplying decks 2 through a drawer-type connector 6. That is to say, a deck side member 6*a* and a body side member 6*b* constituting drawer-type connector 6 are connected with each other under the condition that the paper supplying deck 2 is mounted on paper supplying portion 1*a* of the body 1 and are separated from each other when the paper supplying deck 2 is dismounted or withdrawn.

Figure 3:
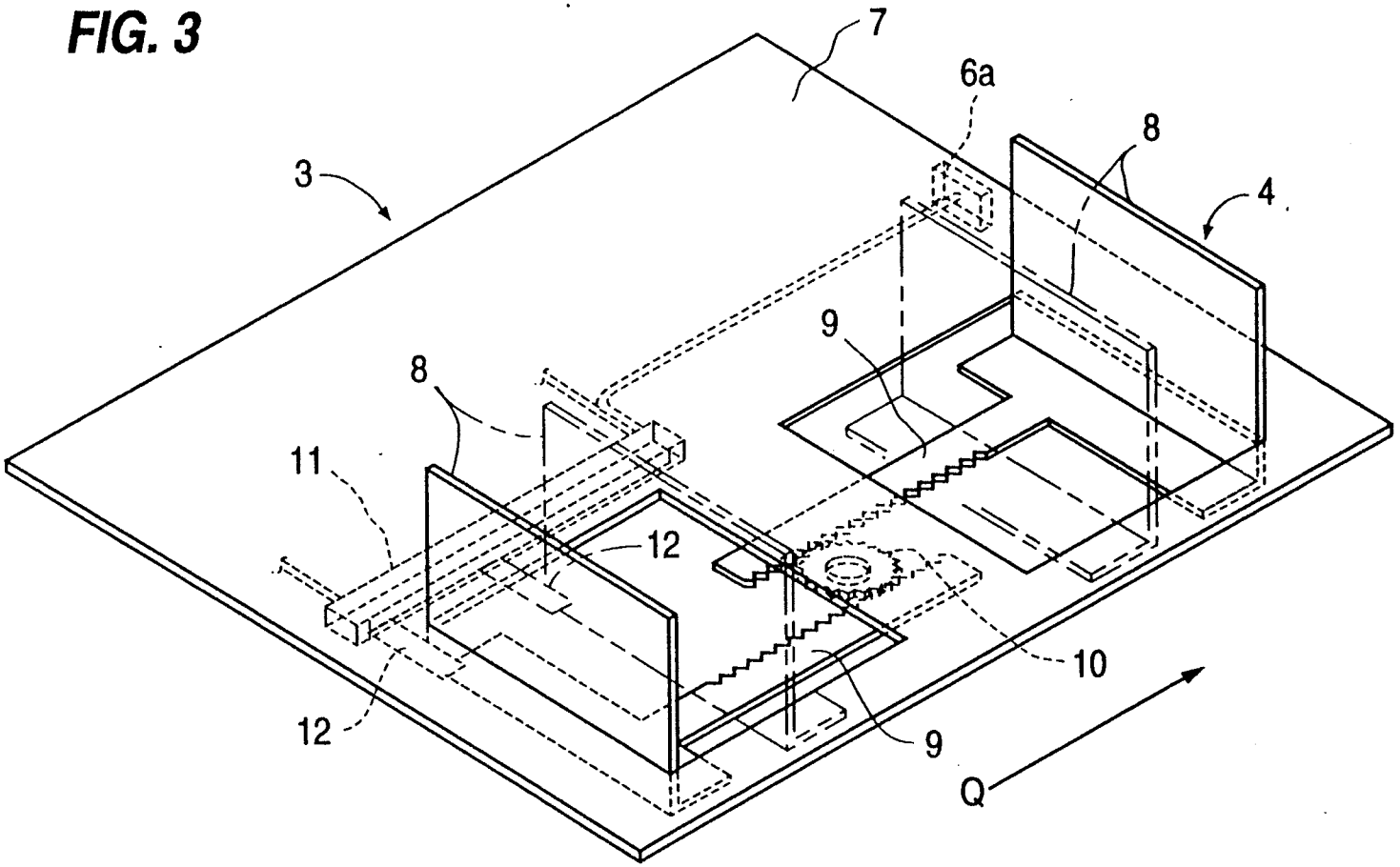
FIG. 3 is a perspective view showing a paper carrying portion of a paper supplying deck in such image forming apparatus.

FIG. 3 is a perspective view roughly showing the paper carrying portion 3 of the paper supplying deck 2. Referring to FIG. 3, reference numeral 7 designates a paper carrying plate provided with a pair of paper end regulating plates 8 constituting the paper width setting mechanism 4. Plates 8 are arranged oppositely and movably in back and forth directions upstream and downstream relative to a moving direction Q of the paper supplying deck 2. The paper end regulating plates 8 are provided with respective racks 9 extending in the back and forth directions and formed at lower ends of plates 8. Thus, plates can be moved in an interlocked relation with a movement of one plate 8 by engaging racks 9 with a pinion 10 pivoted below paper carrying plate 7.

In addition, a variable resistor 11 is arranged in the moving direction of the plates 8 below paper carrying plate 7, and a sliding tap 11*a* (refer to FIG. 1) of variable resistor 11 is connected with a lower end of one paper end regulating plate 8 through a connecting member 12. Thus, a resistance value of the variable resistor 11 is variable set in an interlocked relation with movement of the paper end regulating plates 8, i.e. a width setting operation of the paper width setting mechanism 4.

Figures 1, 4:
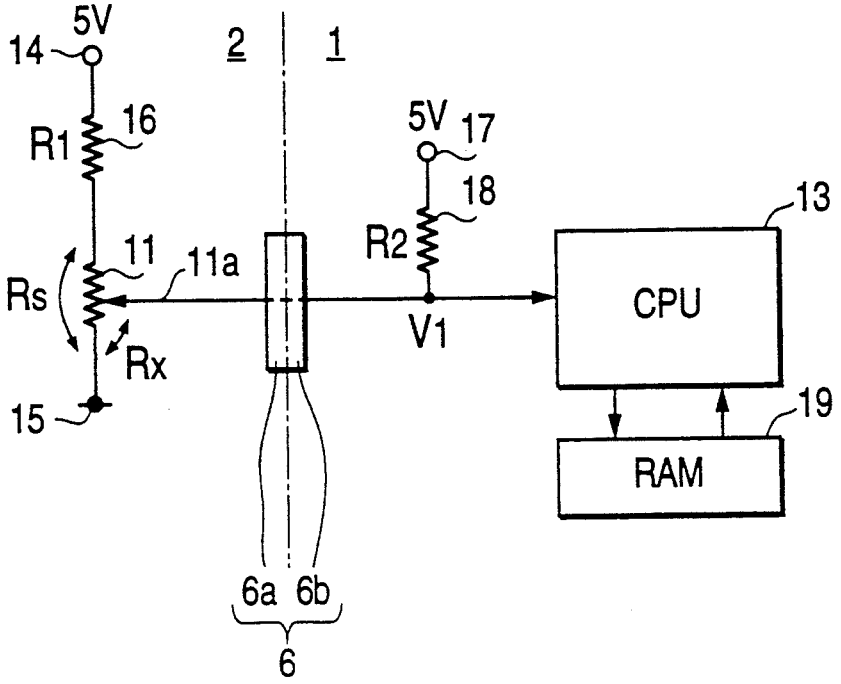
FIG. 1 is a circuit diagram relating to a first preferred embodiment of a first aspect of the present invention.
FIG. 4 is a data map of paper width standard data written in a RAM of the image forming apparatus.

FIG. 1 is a circuit diagram showing an electric connecting structure between the variable resistor 11 on the side of the paper supplying deck 2 and a controller 13 on the side of the body 1. Referring to FIG. 1, on the side of the paper supplying deck 2, the variable resistor 11 and an upper limit voltage suppressing resistance 16 are connected in series between a constant voltage power source 14 of 5V and a ground 15. That is, resistance 16 and the variable resistor 11 are connected in the order described from the side of constant voltage power source 14, and sliding tap 11*a* of the variable resistor 11 is connected with deck side member 6*a* of the drawer-type connector 6. The upper limit voltage suppressing resistance 16 ensures that a voltage output from the sliding tap 11*a* is lower than the voltage (5V) of the constant voltage power source 14 even if the resistance value of the variable resistor 11 becomes maximum, i.e. a resistance value $R_x$ between the sliding tap 11*a* and ground 15 becomes equal to a total resistance value $R_s$ of the variable resistor 11.

On the other hand, on the side of the body 1, a constant voltage power source 17 of 5V is connected with body side member 6*b* of the drawer-type connector 6 through a pull up resistance 18, and the body side member 6*b* is connected with one analog input port of a controller 13. A resistance value $R_2$ of pull up resistance 18 is set so as to be sufficiently large compared with a resistance value $R_1$ of the upper limit voltage suppressing resistance 16 and total resistance value $R_s$, that is so that the following relation (1) occurs:

$$R_2 > R_1, R_S \quad (1)$$

The controller 13 consists of a microcomputer, and a RAM 19 for memorizing various types of data is connected with controller 13.

Next, an operation under the condition that the paper supplying deck 2 is mounted on the paper supplying portion 1*a* of the body in the above described paper supplying device will be described. Under the condition that the paper supplying deck 2 is not mounted on the paper supplying portion la of the body 1, i.e. the deck side member 6*a* and the body side member 6*b* forming the drawer-type connector 6 are separated from each other, a voltage $V_{1OUT}$ of the body side member 6*b* is expressed by the following expression:

$$V_{1OUT} \approx 5V$$

On the contrary, under the condition that the paper supplying deck 2 is mounted on the paper supplying portion 1*a* of the body 1, i.e. the deck side member 6*a* and the body side member 6*b* of the drawer-type connector 6 are connected with each other, a voltage $V_{1IN}$ of the body side member 6*b* is expressed by the following expression (2) on the basis of the expression (1):

$$V_{1IN} = R_X/(R_1 + R_S) \times 5(V) \quad (2)$$

wherein $R_x$ represents a resistance value from the sliding tap 11*a* to a ground side terminal in the variable resistor 11, $R_1$ represents a resistance value of the upper limit voltage suppressing resistance 16, and $R_s$ represents a total resistance value of the variable resistor 11.

Accordingly, under the condition that the paper supplying deck 2 is mounted on the paper supplying portion 1*a* of the body 1, the maximum value $V_{1INMAX}$ of voltage $V_{1IN}$ of the body side member 6*b* of the drawer-type connector 6 is expressed by the following expression (3):

$$V_{1INMAX} = R_S/(R_1 \times R_6) \times 5(V) < 5(V) \quad (3)$$

That is to say, the following expression (4) occurs:

$$V_{1OUT} > V_{1INMAX} \quad (4)$$

That is, the voltage $V_{1IN}$ input to the controller 13 from the body side member 6*b* under the condition that the paper supplying deck 2 is mounted on the paper supplying portion 1*a* of the body 1, i.e. the paper width detecting signal, is always of low level compared with the voltage $V_{1OUT}(\approx 5V)$ input to the analog input port of the controller 13 from the body side member 6*b* under the condition that the paper supplying deck 2 is not mounted on the paper supplying portion 1*a* of the body 1. Thus, it can be judged in the controller 13 whether or not the paper supplying deck 2 is mounted on the paper supplying portion 1*a* of the body 1. That is to say, it can be judged that when the voltage input to the controller 13 from the body side member 6*b* of the drawer-type connector 6 has a value close to 5V the paper supplying deck 2 is mounted on the paper supplying portion 1*a* of the body 1, while it can be judged that when the voltage input to the controller 13 from the body side member 6b of the drawer-type connector 6 has a value lower than 5V the paper supplying deck 2 is not mounted on the paper supplying portion 1a of the body 1.

In addition, a plurality of paper width standard data corresponding to the paper widths of respective typical papers P for comparing a paper width detecting signal $V_{IN}$ therewith, to judge to which paper width such signal corresponds, are previously written or entered in RAM 19 in an assembling step. That is to say, when such paper standard data are entered, the paper width detecting signals $V_{1IN1}$, $V_{1IN2}$... input to the controller 13 through the drawer-type connector 6 are written in the RAM 19 as a data map shown in FIG. 4 in correspondence to, for example, respective typical papers B6, B5, ... every time when the respective typical papers P are carried on the paper carrying portion 3 of the paper supplying deck 2, i.e. when the paper end regulating plates 8 of the paper width setting mechanism 4 are moved to accommodate the width of the respective papers P, thereby setting the paper width. Thus, by entering the paper width standard data in the RAM 19 in the above described manner, even in the case where the resistance value of the variable resistor 11 is dispersed, it is possible to omit an operation that a semi-fixed resistance is connected in series with the variable resistor 6 and such semi-fixed resistance is regulated so that the previously determined voltage corresponding to the respective typical papers, i.e. the paper width detecting signal, may be obtained.

Figure 5:
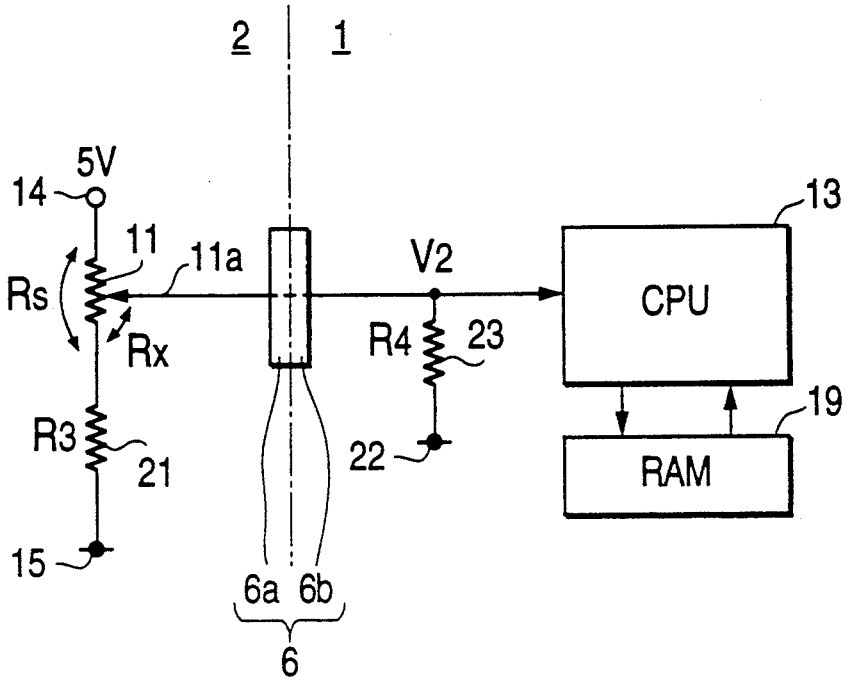
FIG. 5 is a circuit diagram relating to a second preferred embodiment of the first aspect of the invention.

FIG. 5 is a circuit diagram showing a second preferred embodiment of the first aspect of the invention. In a paper supplying device according to this preferred embodiment, on the side of the paper supplying deck 2 the variable resistor 11 and a lower limit voltage rising resistance 21, used in place of the upper limit voltage suppressing resistance 16 in the above described first preferred embodiment, are connected in series between the constant voltage power source 14 and the ground 15. That is, resistance 21 and the variable resistor 11 are connected in the order described from the side of the ground 15. On the other hand, on the side of the body 1, a pull down resistance 23 is connected between the body side member 6b of the drawer-type connector 6 and the ground 15 in place of the pull up resistance 18 in the first preferred embodiment. A resistance value $R_4$ of pull down resistance 23 is set so as to be sufficiently large as compared with a resistance value $R_3$ of the lower limit voltage rising resistance 21 and the total resistance value $R_s$ of the variable resistor 11, that is, so that the following relation (5) occurs:

$$R_4 > R_3, R_S \quad (5)$$

Other constructions of this embodiment are similar to those in the first preferred embodiment.

In this second preferred embodiment, under the condition that the paper supplying deck 2 is not mounted on the paper supplying portion 1a of the body 1, a voltage $V_{2OUT}$ of the body side member 6B of the drawer-type connector 6 is expressed by the following expression:

$$V_{2OUT}=0(V)$$

On the contrary, under the condition that the paper supplying deck 2 is mounted on the paper supplying portion 1a of the body 1, a voltage $V_{2IN}$ of the body side member 6b is expressed by the following expression (6) on the basis of the expression (5):

$$V_{2IN}=(R_3+R_X)/(R_3+R_S)\times 5(V) \quad (6)$$

Accordingly, under the condition that the paper supplying deck 2 is mounted on the paper supplying portion 1a of the body 1, the minimum value $V_{INMIN}$ of voltage $V_{2IN}$ of the body side member 6b is expressed by the following expression (7):

$$V_{2INMIN}=R_3/(R_3+R_S)\times 5(V)>0(V) \quad (7)$$

Therefore, the following expression (8) occurs:

$$V_{2INMAX}>V_{2OUT}=0(V) \quad (8)$$

That is to say, the voltage $V_{2IN}$ input to the controller 13 from the body side member 6b under the condition that the paper supplying deck 2 is mounted on the paper supplying portion 1a of the body 1, i.e. the paper-width detecting signal, is always high in level as compared with the voltage $V_{2OUT}(=0V)$ input to the controller 13 from the body side member 6b under the condition that the paper supplying deck 2 is not mounted on the paper supplying portion 1a of the body 1. Thus, it can be judged in the controller 13 whether or not the paper supplying deck 2 is mounted on the paper supplying portion 1a of the body 1. That is to say, it can be judged that when the voltage input to the controller 13 from the body side member 6b *of the drawer-type connector 6 has a value of* 0V then the paper supplying deck 2 is not mounted on the paper supplying portion 1a of the body 1, while it can be judged that when the voltage input to the controller 13 from the body side member 6b of the drawer-type connector 6 has a value higher than 0V then the paper supplying deck 2 is mounted on the paper supplying portion 1a of the body 1.

Figure 7:
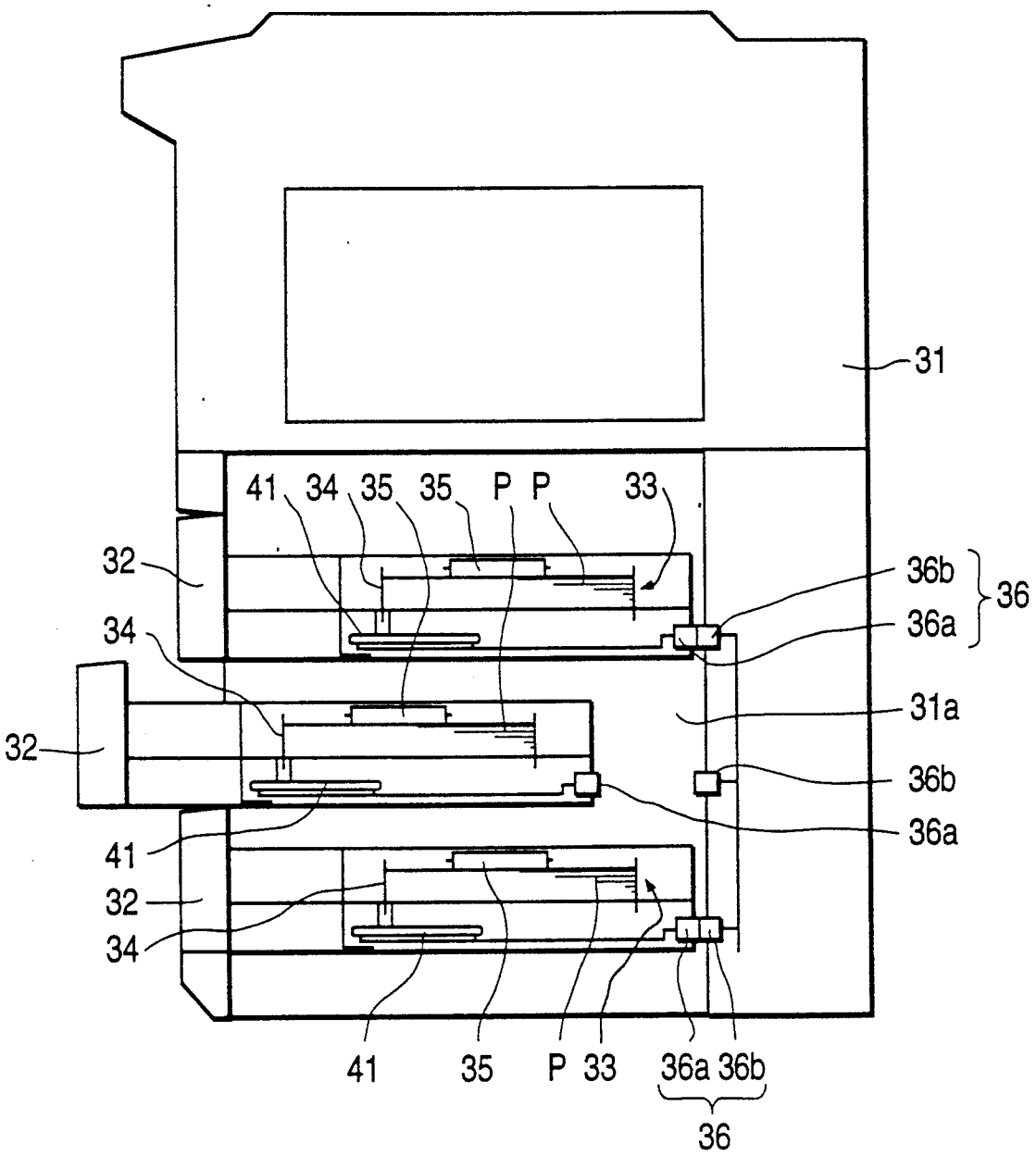
FIG. 7 is a side sectional view roughly showing an image forming apparatus to which such second aspect of the invention is applied.

Next, a second aspect of the invention will be described. FIG. 7 is a side sectional view roughly showing a front loading-type image forming apparatus to which the second aspect of the invention is applied. Referring to FIG. 7, reference numeral 31 designates a body of the image forming apparatus of which paper supplying portion 31a is provided with a plurality of paper supplying decks 32 so as to be inserted therein and withdrawn therefrom in a multi-step manner from a front side of body 31. Each paper supplying deck 32 is provided with a paper carrying portion 33 having a paper width setting mechanism 34 and a paper supplying roller 35 for supplying paper supplying portion 31a of the body 31 with a paper P carried on paper carrying portion 33. The body 31 is electrically connected with the paper supplying decks 32 through a drawer-type connector 36. That is to say, a deck side member 36a and a body side member 36b forming drawer-type connector 36 are connected with each other under the condition that the paper supplying deck 32 is mounted on paper supplying portion 31a of the body 31 and are separated from each other when the paper supplying deck 32 is dismounted or withdrawn.

Figure 8:
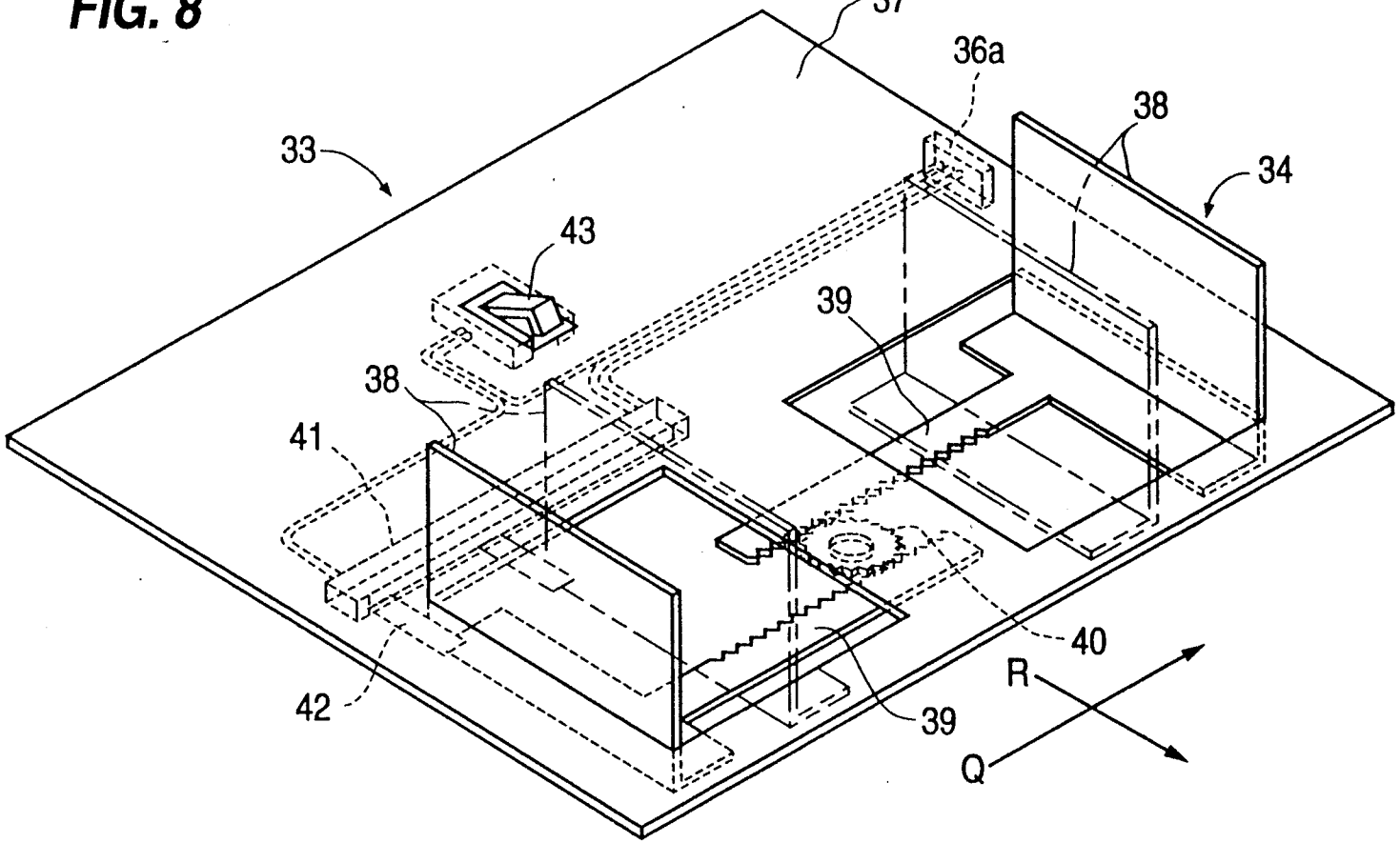
FIG. 8 is a perspective view showing a paper carrying portion of a paper supplying deck in such image forming apparatus.

FIG. 8 is a perspective view roughly showing the paper carrying portion 33 of the paper supplying deck 32. Referring to FIG. 8, reference numeral 37 designates a paper carrying plate provided with a pair of paper end regulating plates 38 constituting the paper width setting mechanism 34. Plates 38 are arranged oppositely and movable in back and forth directions upstream and downstream relative to a moving direction Q of the paper supplying deck 32. The paper end regulating plates 38 are provided with respective racks 39 extending in the back and forth directions and formed at lower ends of the plates 38. Thus, plates 38 can be moved in an interlocked relation with a movement of plate 38 by engaging racks 39 with a pinion 40 pivoted below paper carrying plate 37.

In addition, a variable resistor 41 is arranged in the moving direction of the plates 38 below paper carrying plate 37, and a sliding tap 41*a* (refer to FIG. 6) of variable resistor 41 is connected with a lower end of one paper end regulating plate 38 through a connecting member 42. Thus, a resistance value of the variable resistor 41 is variable set in an interlocked relation with movement of the paper end regulating plates 38, i.e. a width setting operation of the paper width setting mechanism 34. In addition, a longitudinal size detecting switch 43 for discriminating the typical papers of centimeter measure, i.e. of B4 from B5 and of A3 from A4, is arranged at the downstream side of the paper width setting mechanism 34 in a direction transverse to moving direction Q of the paper supplying deck 32, i.e. in a paper supplying direction R.

That is to say, when typical papers B5, A4 size are carried on paper carrying portion 33 with short sides thereof parallel to paper supplying direction R, rear portions thereof are not overlapped on switch 43. However, when typical papers of B4, A3 size are carried on the paper carrying portion 33 with short sides (equal to long sides of typical papers of B5, A4 size, respectively) thereof parallel to moving direction Q, rear portions thereof are overlapped on the switch 43. The switch 43 is an always closed switch which is pushed down and switched off by rear portions of the paper P carried on the paper carrying portion 33 and is maintained switched on when not pushed down.

Figure 6:
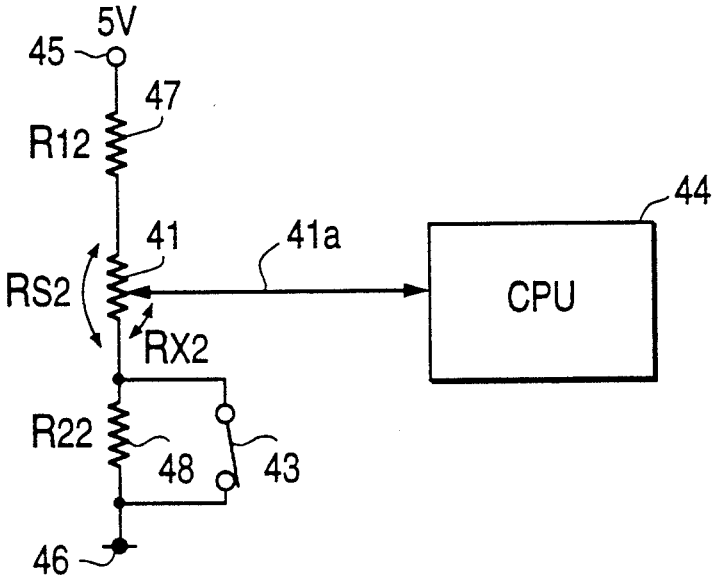
FIG. 6 is a circuit diagram relating to one preferred embodiment of a second aspect of the present invention.

FIG. 6 is a circuit diagram showing an electric connecting structure between the side of the paper supplying deck 32 and a controller 44 consisting of a microcomputer included on the side of the body 31. In FIG. 6, in order to simplify the circuit, the drawer-type connector 6 is omitted. Referring to FIG. 6, a resistance 47, a variable resistor 41 and a resistance 48 are connected in series between a constant voltage power source 45 of 5V and a ground 46. That is, resistance 47, variable resistor 41 and resistance 48 are connected in the order described from the side of constant voltage power source 45. The switch 43 is connected in parallel with the resistance 48, and a sliding tap 41*a* of the variable resistor 41 is connected with an analog input port of controller 44. A resistance value $R_{22}$ of the resistance 48 is set to be larger than a total resistance value $R_{S2}$ of the variable resistor 41 so that a level of a voltage output from sliding tap 41*a* when the switch 43 is switched off always will be higher than that when the switch 43 is switched on.

Next, an operation of detecting sizes of typical papers of centimeter measure in the above described paper supplying device will be described. In the case where the papers P carried on the paper carrying portion 33 of the paper supplying deck 2 are B6, A5, B5R, A4R, B5 and A4 size, rear portions of such papers are not overlapped on the switch 43, so that switch 43 is kept under the switched-on condition. Accordingly, a width direction size detecting voltage $V_{ON2}$ output from the sliding tap 41*a* of the variable resistor 41 at such time is expressed by the following expression (9):

$$V_{ON2}=R_{X2}/(R_{12}+R_{S2})\times 5(V) \quad (9)$$

wherein $R_{X2}$ represents a resistance value from the sliding tap 41*a* to a ground-side terminal in the variable resistor 41.

In such case, width direction size detecting voltage $V_{ONMAX2}$ when $R_{X2}$ becomes the maximum value ($=R_{S2}$) is expressed by the following expression (10):

$$V_{ONMAX2}=R_{S2}/(R_{12}+R_{S2})\times 5(V) \quad (10)$$

On the contrary, in the case where the papers P carried on the paper carrying portion 33 of the paper supplying deck 2 are B4 and A3 size, the rear portions of the papers are overlapped on the switch 43, so that the switch 43 is pushed down and switched off. Accordingly, the width direction size detecting voltage $V_{OFF2}$ output from the sliding tap 41*a* at such time is expressed by the following expression (11):

$$V_{OFF2}=(R_{X2}+R_{22})/(R_{12}+R_{S2}+R_{22})\times 5(V) \quad (11)$$

In such case, the width direction size detecting voltage $V_{OFFMIN2}$ when $R_{X2}$ becomes the minimum value (=0) is expressed by the following expression (12):

$$V_{OFFMIN2}=R_{22}/(R_{12}+R_{S2}+R_{22})\times 5(V) \quad (12)$$

Figure 9:
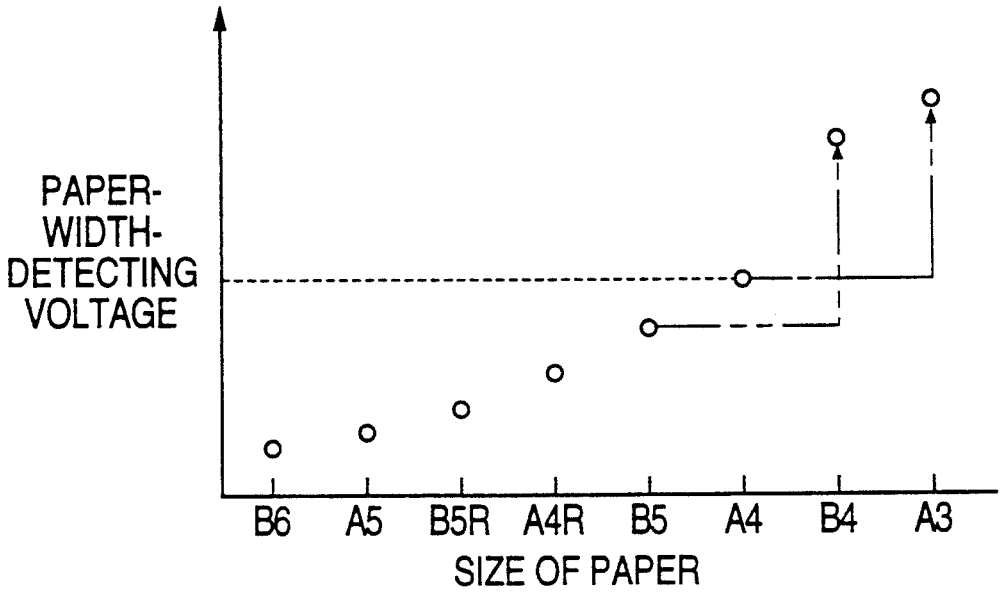
FIG. 9 is a graph showing a relation between a size of a paper and a paper width detecting voltage.
Figure 10:
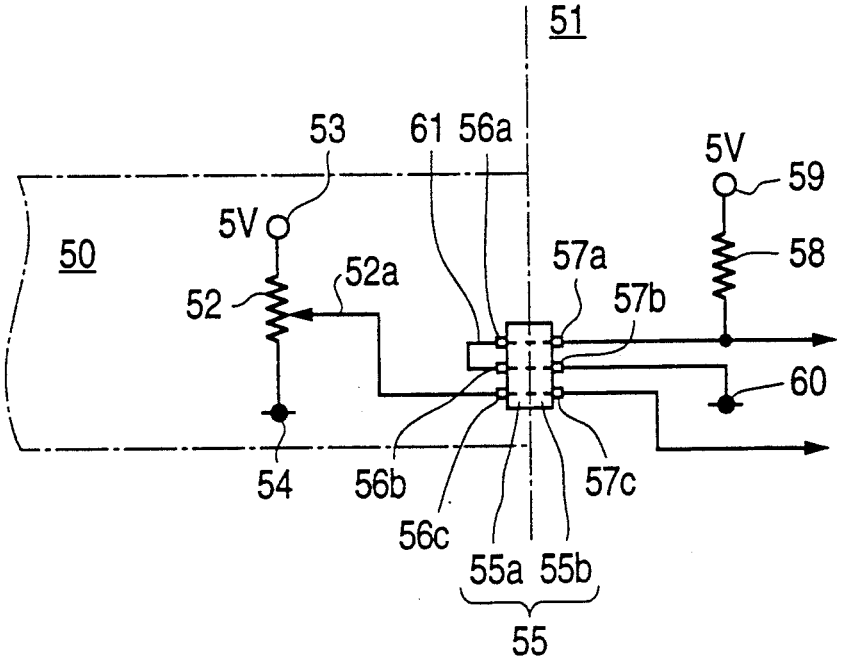
FIG. 10 is a circuit diagram of a circuit for achieving a conventional connecting/detecting method.
Figures 11, 12:
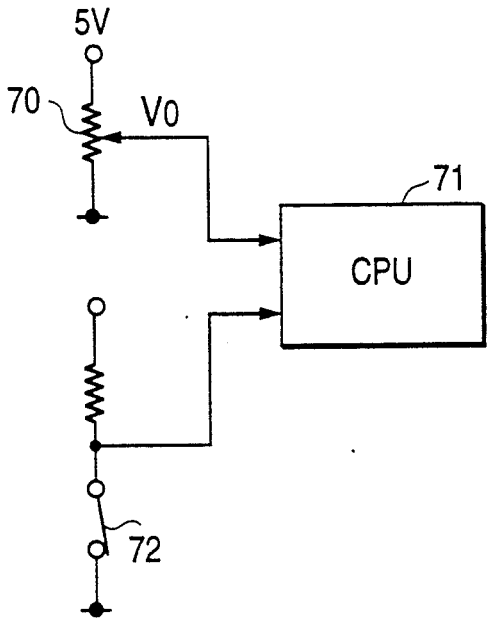
FIG. 11 is a diagram showing the conventional method of detecting a size of a paper.
FIG. 12 is a circuit diagram showing a conventional circuit for detecting a size of a paper.

As above described, $R_{22}$ is set to be larger than $R_{S2}$ so that the following expression (13) occurs, whereby the width direction size detecting voltage $V_{OFFB4}$ in the case where the papers P are B4 size, as shown in FIG. 9, is higher than the width direction size detecting voltage $V_{ONA4}$ in the case where the papers P are A4 size, and also the width direction size detecting voltage $V_{OFFA3}$ in the case where the papers P are A3 size is higher than $V_{ONA4}$:

$$V_{ONMAX2}>V_{OFFMIN2} \quad (13)$$

In addition, the following relation (14) occurs between $V_{OFFB4}$ and $V_{OFFA3}$:

$$V_{OFFB4}>V_{OFFA3} \quad (14)$$

Thus, the controller 44 can discriminate not only papers of B4 size from papers of B5 size but also papers of A3 size from papers of A4 size.

In addition, although the case were the paper width setting mechanism 34 and the longitudinal size detecting switch are carried on the paper supplying deck 32 is described above with regard to this preferred embodiment, the paper supplying device according to the present invention also can be employed with an image forming apparatus in which the paper width setting mechanism 34 and the longitudinal size detecting switch 43 are carried on a normal paper supplying cassette not provided with a paper supplying roller.

What is claimed is:

1. A paper supplying device comprising:

a body;

paper supplying deck insertable into and withdrawable from a paper supplying portion of said body and having a paper carrying portion with a paper width setting mechanism and a variable resistor a resistance value of which changes in an interlocked relation with said paper width setting mechanism to output a paper width detecting voltage in dependence on said resistance value;

a drawer-type connector electrically connecting a side of said paper supplying deck with a side of said body when said deck is mounted in said body;

a limit voltage avoiding resistance, which prevents said paper width detecting voltage from amounting to a power source voltage even though said resistance value of said variable resistor reaches a maximum value, connected in series with said variable resistor on said side of said deck; and a pull up resistance connected with said connector on said side of said body to discriminate voltages in said connector on said side of said body between a voltage there at when said deck is mounted in said body and a voltage when said deck is not mounted in said body.

2. A paper supplying device comprising:

a body;

a paper supplying deck insertable into and withdrawable from a paper supplying portion of said body and having a paper carrying portion with a paper width setting mechanism and a variable resistor a resistance value of which changes in an interlocked relation with said paper width setting mechanism to output a paper width detecting voltage in dependence on said resistance value;

a drawer-type connector electrically connecting a side of said paper supplying deck with a side of said body when said deck is mounted in said body;

a limit voltage avoiding resistance, which prevents said paper width detecting voltage from amounting to a ground voltage even though said resistance value of said variable resistor reaches a minimum value, connected in series with said variable resistor on said side of said deck; and a pull down resistance connected with said connector on said side of said body to discriminate voltages in said connector on said side of said body between a voltage there at when said deck is mounted in said body and a voltage when said deck is not mounted in said body.

3. A paper supplying device comprising:

a body;

a paper supplying box to carry papers and having a paper width setting mechanism, a variable resistor, a resistance value of which changes in an interlocked relation with said paper width setting mechanism to output a paper width detecting voltage corresponding to said resistance value, and a switch for use in detection of a paper size in the longitudinal direction and for detecting a rear portion of papers carried on said paper supplying box;

a resistance larger than the total resistance of said variable resistor connected in series with said variable resistor; and said switch being connected in parallel with said larger resistance so that said paper width detecting voltage output from said variable resistor may be input to a controller as a signal of paper size in the longitudinal direction.

4. A paper supplying device as set forth in claim 3, wherein said paper width setting mechanism and said longitudinal size detecting switch are carried on a paper supplying deck.

* * * * *